United States Patent [19]
Stahl et al.
[11] 4,208,255
[45] Jun. 17, 1980

[54] PROCESS AND DEVICE FOR THE PRODUCTION OF METAL-COMPLEX COMPOUNDS SUITABLE FOR ELECTROLESS METAL DEPOSITION

[75] Inventors: Fritz Stahl, Am Kehn; Horst Steffen, Geldern, both of Fed. Rep. of Germany

[73] Assignee: Kollmorgen Technologies Corporation, Dallas, Tex.

[21] Appl. No.: 885,649

[22] Filed: Mar. 13, 1978

[30] Foreign Application Priority Data

Mar. 23, 1977 [DE] Fed. Rep. of Germany ..... 2713392

[51] Int. Cl.[2] ..... C25B 3/12

[52] U.S. Cl. ..... 204/72; 204/52 Y; 204/59 R; 427/305

[58] Field of Search ..... 204/59 QM, 72; 427/305

[56] References Cited

U.S. PATENT DOCUMENTS

| | | | |
|---|---|---|---|
| 1,129,307 | 2/1915 | Marsh | 204/72 |
| 2,865,832 | 12/1958 | Pitzer | 204/222 |
| 3,474,011 | 10/1969 | Guertin et al. | 204/49 |
| 3,957,600 | 5/1976 | Ives et al. | 204/105 R |
| 3,962,494 | 6/1976 | Nuzzi | 427/304 |

FOREIGN PATENT DOCUMENTS

| | | | |
|---|---|---|---|
| 400581 | 10/1973 | U.S.S.R. | 204/59 R |

*Primary Examiner*—F. C. Edmundson
*Attorney, Agent, or Firm*—Morgan, Finnegan, Pine, Foley & Lee

[57] ABSTRACT

Metal-complex compounds suitable for use in the electroless deposition of said metal are formed in aqueous solution by a method which comprises providing an aqueous solution of the complexing agent, immersing in the solution at least one anode comprising the metal to be deposited and at least one cathode, the anode and cathode being connected to an adjustable current source, applying a current to the anode and cathode to create a voltage difference therebetween which is sufficient to dissolve metal from the anode into the aqueous solution of the complexing agent and thereby form a compound of the metal and complexing agent, and depositing a lesser amount of metal from solution onto the cathode to enrich the solution in the metal-complex compound. In other embodiments of the invention, devices for carrying out the process are also provided.

17 Claims, 2 Drawing Figures

PROCESS AND DEVICE FOR THE PRODUCTION OF METAL-COMPLEX COMPOUNDS SUITABLE FOR ELECTROLESS METAL DEPOSITION

BACKGROUND OF THE ART

Baths for the chemical deposition of metal, also known as electroless metal deposition baths to distinguish from galvanic baths, have enjoyed increasing use in the metallizing of normally electrically non-conductive materials, among other applications. In practice, in such methods a layer of metal is built up on the surface of the insulating material entirely by means of chemical deposition, or an electrically conductive layer of metal produced by chemical deposition is treated further to deposit additional metal by means of electrolytic techniques.

Chemical metallizing baths principally contain ions of the metal to be deposited, a complexing agent for such ions, a reducing agent for such ions and a pH-adjustor. In general, such baths also include stabilizers, as well as agents for improving the ductility, tensile strength, structure and other characteristics of the metal deposited.

By the oxidation of the reducing agent in specific areas, i.e., at catalytic nuclei on the surface of the article being treated, electrons necessary for the conversion of the metal ions into elemental metal are delivered into the bath. The oxidation, and hence the deposition of metal, is triggered by such catalytic nuclei, which are formed from precious metals and certain other metals or metal compounds. In general, solutions are employed for such baths in which the deposited metal also catalyzes the oxidation and thus the further deposition of metal. Such solutions are referred to as autocatalytic metallizing baths.

During the operation of the bath, the metal ions, reducing agent and other bath constituents are consumed. This results in a falling off in the rate of metal deposition and, eventually, to a complete cessation of metal deposition. It has become the practice to replenish such baths, either continuously or intermittently, by adding further amounts of the constituents being consumed. The replenishment is controlled by ordinary batch-wise chemical analysis, or by the use of automatic analyzing or proportioning devices.

During such replenishments, care must be taken to ensure that local conditions do not arise which result in bath instability or in the formation of additional catalytic nuclei which can cause the uncontrolled deposition of metal or the destruction of the bath itself. Moreover, when additions of chemicals are made it is difficult to avoid the introduction of foreign ions which interfere with the deposition process, or to do so under economically justifiable conditions.

Another significant disadvantage of prior art methods of operating chemical metallizing baths is that the further addition of consumable bath ingredients results in increases in the volume of the bath. This necessitates the removal of excess amounts of bath liquid, e.g., by skimming off the overflow, or by other suitable means, even though the excess is useful. It has been proposed that such increases in bath volume can be kept low by adding the consumable bath ingredients in the form of concentrated solutions. However, such methods have enjoyed only limited used because the replenishment of the metal ion to be deposited, usually in the form of a soluble metal salt, also makes it necessary to add more of the pH adjustor. Moreover, other salts form as by-products, and this leads to increases in the bath density.

For example, in the case of copper chemical deposition baths having a pH value in the alkaline range, either alkali metal sulfates or alkali metal chlorides are formed, dependng upon the particular copper salt used. In addition, in such baths copper formates also appear as by-products when formaldehyde is employed as the reducing agent. Because the activity of the bath and the quality of the metal being deposited are adversely affected by high bath densities, it is desirable to keep the density within a specified range. To this end, more water is added to dilute the bath, but this leads to further increases in the bath volume and a loss of useable bath liquid by overflow.

It is known that, for purposes of economy and environmental protection, the overflow of excess liquid from such baths can be treated to remove metals, e.g., nickel, copper, and the like, as well as complexing agents for such metals, and to remove or break down other bath constituents which are harmful to the environment. The devices which are suitable for achieving the foregoing also complicate the operation of chemical metallizing plants and tend to increase manufacturing costs, however.

It is a principal object of this invention to provide a process which permits the operation of chemical metallizing baths without the aforementioned shortcomings of prior art methods of operation.

DESCRIPTION OF THE INVENTION

In accordance with this invention, there is provided a method of forming a water soluble compound of a metal and a complexing agent useful in the electroless deposition of said metal from an electroless metal deposition solution, said method comprising:

(i) providing an aqueous solution comprising said complexing agent;

(ii) immersing in said solution at least one anode comprising said metal to be deposited and at least one cathode, said anode and cathode being connected to an adjustable current source;

(iii) applying a current to said anode and cathode from said current source to create a voltage difference therebetween at least sufficient to dissolve metal from said anode into said solution, and thereby to form a complex compound of said metal with said complexing agent therein; and (iv) depositing metal from said solution onto said cathode in a total amount which is less than that dissolved at said anode, to provide an aqueous solution which is enriched with said compound of said complexing agent and metal.

The cathode or cathodes may be made of either the same metal as that of the anode, i.e., the metal which is to be deposited during the electroless metal deposition process, or the cathode may comprise a precious metal, graphite or any other material which is inert with respect to the electroless metal deposition bath solution.

Other ingredients which are commonly employed during electroless deposition may also be added to the solution in which the complex compound of the metal is formed. The pH of this solution can be regulated by known means, i.e, by the addition of a pH adjustor. Preferably, the pH is adjusted to a value which corresponds to that of the electroless metal deposition bath solution.

Without wishing to be bound by any theory of the invention, the rate of formation of metal ions at the anode, the rate of metal deposition at the cathode, and the rate of enrichment of the solution with the complex compound of the metal, are all functions of the stability of the metal complex. After aqueous solution has been enriched with the complex compound of the metal, it may then be used for repenishing the electroless metal deposition bath solution.

In another aspect of the invention, the metal-complex formation may be conducted in the same vessel as that of the electroless metal deposition bath, or in the electroless metal deposition bath solution itself.

It is preferred that the complex formation be carried out under continuous mixing. The mixing can be provided by mechanical means or by the action of compressed air. The latter is especially preferred because, due to the bubbling action or, perhaps, for some other reason, the efficiency of the formation of the metal complex is enhanced, and the formation of undesirable metal compounds or metal precipitates is, for all practical purposes, prevented.

If the metal content of an electroless metal deposition bath is to be replenished with this invention, the metal-complex formation can be carried out in a separate container from that of electroless metal deposition bath, and the respective solutions can be exchanged between the containers. This can be done continuously or on an intermittent basis by the use of pumping means. When pumping means are employed, it is preferred that filtration means be included in the path of the flow between the containers.

In order to make use of the metal which is deposited on the anode or anodes, it is desirable to exchange the anodes and cathodes from time to time.

In a still further aspect of this invention, an electroless metal deposition bath is used to build up an electrically conductive layer of metal on the surface of an insulating material. The layer of deposited metal is then used as a cathode, so that simultaneously with the formation of metal ions at the anode additional metal is deposited electrolytically on the conductive metal layer already on the surface of the insulating article. This permits shortened residence times for the metal deposition process.

This invention also contemplates novel devices which are suitable for the practice of the aforementioned processes. One such device comprises:

(a) a first liquid-tight vessel having a bottom and four sides;

(b) a second liquid-tight vessel having a bottom and four sides, said vessel including at least one anode comprising the metal to be deposited, at least one cathode and an adjustable current source connected to said anode and cathode; and (c) connecting means for transferring liquid between (a) and (b).

Preferably but not necessarily, the anode comprises a wire basket made of an inert material, e.g., titanium, the basket being filled with granules of the metal to be deposited, e.g., copper.

In those embodiments where it is desired to form the complex compound of the metal in the electroless metal deposition bath solution itself, a suitable device comprises a single vessel in which the anode and cathode are spaced apart. The vessel also includes holding means for supporting the article to be metallized between the anode and cathode in metal deposition solution, such that substantially all of the surface of the article is exposed to the metal deposition solution. The holding means is connected to the current source and provided with adjustable clamping element capable of an "open" position and a "closed" position. In the "closed" position, the clamping element connects the layer of metal deposited on the surface of the article as a cathode to the current source.

DESCRIPTION OF THE SPECIFIC EMBODIMENTS

The processes and articles of this invention are further illustrated in the following examples, which are not intended to be limiting.

EXAMPLE 1

Within the interior of a hollow container made of polypropylene, there are arranged two cathodes of copper and one anode. The anode consists of titanium mesh shaped in the form of a basket, the basket being filled with granules of copper. In place of this anode, a solid copper anode may also be used; the cathode may be substituted with one made of graphite or other suitable material.

The container is filled with the solution comprising 55 grams per liter (g/l) of EDTA, and the pH is adjusted to 12.6. A potential of 5.5 volts is applied across the electrodes which results in a current density of 10 amperes per square decimeter (amps/dm$^2$). After the desired concentration of copper is achieved, the solution may be used for replenishing an electroless metal deposition bath.

EXAMPLE 2

Figure 1:
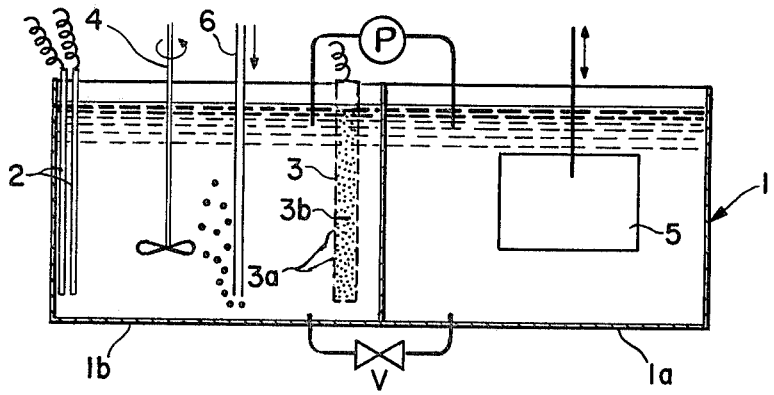

A two-part container, with reference to FIG. 1 having a total volumetric capacity of 16 liters, one part 1*a* of which is for electroless copper deposition and the second part 16 of which is for metal-complex formation, is filled with a solution having the following composition:

| Ingredients | Amount |
|---|---|
| $CuSO_4 \cdot 5H_2O$ | 11 g/l |
| formaldehyde | 6–7 ml/l |
| EDTA | 55 g/l |
| sodium cyanide | 0.01 g/l |
| pH | 12.6 |

The second part of the container contains two cathodes 2 of copper having the dimensions 1 millimeter (mm) by 10 centimeters by 10 centimeters, and an anode 3 comprising a basket of titanium wire 3*a*, the basket being filled with granules of copper 3*b*. A pumping means for transferring the liquid between the first and second containers is also provided. The second container contains a mechanical mixing device 4.

A potential of 5.5 volts is applied between the anode and the cathodes, which results in a current density of 10 amps/dm$^2$. Panels 5 of insulating material prepared for chemical metallizing, i.e., with a loding of 7 square decimeters per liter (dm$^2$/l), are placed in the first container. A layer of copper is deposited on the surface of these at a rate of 2.25 microns per hour ($\mu$/hr.) At the same time, a copper/EDTA complex is formed in the solution in the second container. The metal complex thus formed is pumped into the first container to replace the amount of copper which has been chemically deposited on the panels. In this manner, a constant concentration of copper is maintained in the copper metallizing bath solution.

The amount of copper fed to the metallizing bath solution can be adjusted by regulating the current density. This can be done, for example, by the use of continuous automatic colormetric analysis of the copper contained in the metallizing bath.

Compressed air 6 is fed to the solution in the second container during the electrolytic formation of the copper/EDTA complex. Compressed air can also be fed to the solution in the first container, which provides an adequate and thorough mixing of the metallizing bath also.

Tests show that the consumption of formaldehyde reducing agent is reduced by about 20%, and the consumption of caustic soda for maintaining the pH is reduced by about 30%, in the copper metallizing bath. Because no sulfates are fed to the metallizing bath, which is necessary in the case of prior art methods, sodium sulfate by-product formation and increases in the bath density are both prevented. Also, increases in bath volume are avoided for the most part, or these are at least drastically reduced.

The current density during the electrolytic metal-complex formation may be increased as desired in order to feed more metal from the anode into the complex forming solution. Decomposition of the metal-complex occurs only at very high current densities, and is thus easily avoided.

EXAMPLE 3

Figure 2:
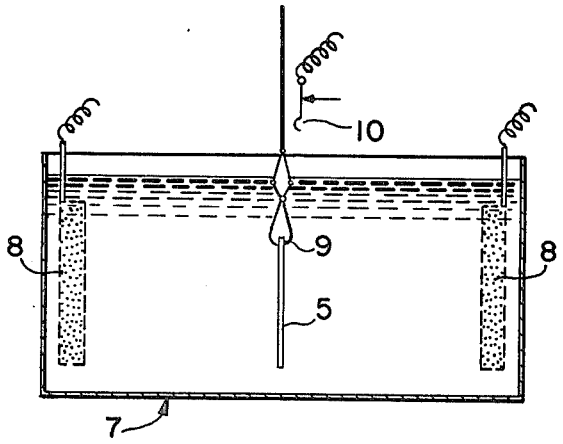

In a rectangular container 7 with reference to FIG. 2: for the electroless deposition of a metal, an electrode basket 8 consisting of titanium wire and filled with copper granules is arranged along the inside of the two longer side walls of the container. The container is filled with an electroless copper deposition bath solution, and one of the two titanium wire baskets is connected as an anode to a source of electric current and the other is connected as a cathode. The container is outfitted with a holding device 9 designed to grip the side edges of panels 5' of a molded laminate made of an insulating material, such that the panels are suspended in the bath solution between the two electrodes with substantially all of the surface to be metallized being exposed. The holding device is also equipped with a clamping element 10 which can be tripped at any desired time and which has an electrical contact element.

Panels comprised of a molded insulating laminate are put into the holding device with the clamping device in the "open" position, and the assembly is immersed in the deposition bath solution. After a layer of metal of desired thickness has been deposited on the panels, the clamping element is immediately activated by moving it to the "closed" position, and the deposited metal layer is thus connected as a cathode to the anodic wire basket.

Because the electrolessly deposited copper is not subject to mechanical or automatic loading, relatively very thin layers of copper are adequate to support electrolytic deposition thereon. Thus, after 5 to 10 minutes of electroless copper deposition, a potential of 1.25 volts may be applied across the electrodes in order to electrolytically deposit copper of excellent quality at a current density of 1 amp/dm$^2$. After 10 minutes of electrolytic deposition, a layer thickness adequate for printed circuit manufacture is obtained. For the latter, the copper surface may be printed with a layer of masking material using known techniques, after which conductor lines of copper are built up on the unmasked areas using conventional galvanic baths. Then the layer of masking material is removed, and the previously masked of copper, which is now exposed, is in turn also removed.

By the selection of a relatively low initial current density at the point of transition from electroless to electrolytic copper deposition in the process of this invention, followed by a gradual increase in the current density as the layer of deposited copper increases in thickness, the duration of both the electroless and electrolytic deposition steps can be shortened even further than normal. Preferably, the metal layer acting as a cathode has a separately adjustable current means.

The use of electrode baskets of the same kind of the material for the anode and cathode, e.g., copper, permits the interchangeable use of the electrodes by reversing the polarity. Thus, the metal which is deposited on the surface of the cathode may be fed back into the electroless metal deposition solution again.

Other modifications and variations of this invention are possible in the light of the above disclosure. It is to be understood, therefore, that changes may be made in the particular embodiments described herein without departing from the scope of the invention as defined in the appended claims.

We claim:

1. A method of forming an aqueous solution of a copper-complex compound useful in the electroless deposition of said copper from an electroless copper deposition solution, the method comprising:

(i) providing an aqueous solution comprising a complexing agent for copper;

(ii) immersing in said solution at least one anode comprising copper and at least one cathode, said anode and cathode being connected to an adjustable current source;

(iii) applying a current to said anode and cathode from said current source to create a voltage difference therebetween at least sufficient to dissolve copper from said anode into said solution, and thereby to form a soluble complex compound of copper and said complexing agent therein; and (iv) depositing copper from said solution onto said cathode in a total amount which is less than that dissolved at said anode, to provide an aqueous solution enriched in said soluble copper-complex compound.

2. A method as defined in claim 1 wherein the pH of the aqueous solution in which the copper-complex compound is formed is adjusted to increase the stability of said copper-complex compound.

3. A method as defined in claim 1 wherein the pH of the solution in which the copper-complex compound is formed is the same as that of said electroless metal deposition solution.

4. A method as defined in claim 1 wherein said cathode also comprises copper.

5. A method as defined in claim 4 wherein said cathode and said anode are interchangeable.

6. A method as defined in claim 1 wherein said anode comprises an inert material in the shape of a basket, said basket containing granules of copper.

7. A method as defined in claim 6 wherein said inert material is titanium.

8. A method as defined in claim 1 wherein said cathode comprises a material selected from among graphite and precious metals.

9. A method as defined in claim 1 wherein the solution in which the copper-complex compound is formed is agitated vigorously.

10. A method as defined in claim 9 wherein the agitation is caused by directing compressed air through said solution.

11. A method as defined in claim 1 wherein the aqueous solution in which the copper-complex compound is formed comprises an electroless copper deposition solution.

12. A method as defined in claim 1 wherein the electroless copper deposition and the copper-complex compound formation are carried out simultaneously.

13. A method as defined in claim 12 wherein said electroless copper deposition and said copper-complex compound formation are conducted simultaneously in separate vessels, the vessels being adapted to permit transfer of the respective solutions of such processes therebetween.

14. A method as defined in claim 12 wherein said electroless copper deposition and said copper-complex compound formation are conducted simultaneously in a common vessel.

15. A method as defined in claim 12 wherein an electrically conductive layer of copper is electrolessly deposited on the surface of an insulating material and said copper layer is used as a cathode in the formation of said copper-complex compound.

16. A method as defined in claim 15 wherein additional copper is electrolytically deposited on said copper layer during said copper-complex formation.

17. A method as defined in claim 16 wherein the current is gradually increased with the increasing thickness of said electrolytically deposited copper layer.

* * * * *

UNITED STATES PATENT AND TRADEMARK OFFICE

CERTIFICATE OF CORRECTION

PATENT NO. : 4,208,255

DATED : June 17, 1980

INVENTOR(S) : Fritz Stahl and Horst Steffen

It is certified that error appears in the above-identified patent and that said Letters Patent are hereby corrected as shown below:

In Col. 3, line 34, "anode or anodes" should read -- cathode or cathodes --.

Signed and Sealed this

Fourteenth Day of April 1981

[SEAL]

Attest:

RENE D. TEGTMEYER

Attesting Officer

Acting Commissioner of Patents and Trademarks